United States Patent [19]

Carter

[11] Patent Number: 4,583,659

[45] Date of Patent: Apr. 22, 1986

[54] CARTRIDGE DISPENSER

[76] Inventor: George L. Carter, Box 322, Sheridan, Mont. 59749

[21] Appl. No.: 494,814

[22] Filed: May 16, 1983

[51] Int. Cl.[4] ..... F42B 39/02

[52] U.S. Cl. ..... 221/279; 221/309; 221/67; 224/239

[58] Field of Search ..... 221/67, 307, 309, 310, 221/279; 224/196, 239

[56] References Cited

U.S. PATENT DOCUMENTS 278,980 6/1883 Livermore et al. ..... 224/196
2,503,741 4/1950 Johnson ..... 221/309
2,756,913 7/1956 Oswald ..... 224/196
3,219,244 11/1965 Black ..... 221/310

FOREIGN PATENT DOCUMENTS 694097 9/1965 Italy ..... 221/67

*Primary Examiner*—H. Grant Skaggs
*Attorney, Agent, or Firm*—Richard C. Conover

[57] ABSTRACT

A cartridge dispenser having structure for securing two columns of cartridges within a housing so that they do not jostle about when the dispenser is used and including structure for guiding the cartridges to the cartridge dispenser opening in a manner which avoids jamming.

3 Claims, 5 Drawing Figures

CARTRIDGE DISPENSER

BACKGROUND OF INVENTION

This invention relates to a cartridge dispenser which, for example, can be worn by a hunter.

Various cartridge holders and dispensers are known in the art including a dispenser for shotgun shells shown in Swedish Pat. No. 3929 which was issued Nov. 5, 1892 and a cartridge holder and carrier shown in U.S. Pat. No. 2,756,913 which was issued July 31, 1956. These dispensers, however, are cumbersome to use by a rifleman.

SUMMARY OF INVENTION

The present invention overcomes the disadvantages of these conventional devices and provides additional advantages over the prior art. The present invention provides a cartridge dispenser which is easy to fill with cartridges arranged in two columns. Further, a user may easily remove a cartridge from the dispenser for immediate loading into a rifle. The present invention includes structure for securing the cartridges when housed by the dispenser so that they do not jostle about when the dispenser is used and structure for guiding the cartridges to the cartridge dispenser opening in a manner which avoids jamming when two columns of cartridges are held in the dispenser at the same time.

A dispenser housing is provided having a top wall, a front wall, a rear wall and an open bottom which provides a dispenser chute to allow the cartridges to be inserted into and to be dispensed from the housing. The rear wall is shaped to direct the cartridges into a single column immediately above the dispenser chute. The dispenser chute includes stop means at one end for holding the bullet end of the cartridge within the interior of the housing. At the other end of the dispenser chute is disposed a resilient means for resiliently engaging the casing of the cartridge for holding the cartridge within the housing.

When a cartridge is desired to be removed, the cartridge is grasped by the user and pulled through the resilient means.

BRIEF DESCRIPTION OF THE DRAWINGS

In order that the invention may be clearly understood and readily carried into effect, a preferred embodiment will now be described by way of example only, with reference to the accompanying drawings wherein.

DESCRIPTION OF PREFERRED EMBODIMENTS OF THE INVENTION

Figure 1:
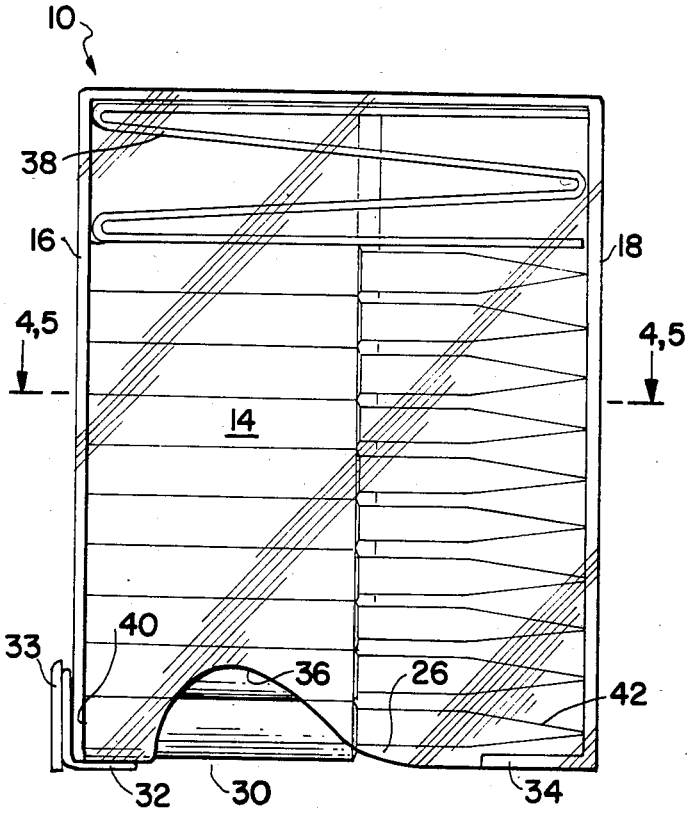
FIG. 1 is an elevational front view of the cartridge dispenser according to the present invention.
Figure 2:
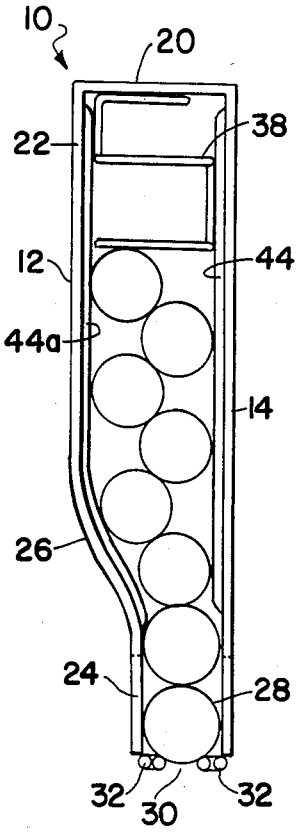
FIG. 2 is a left side view of the cartridge dispenser shown in FIG. 1 with the left side wall removed and showing cartridges disposed within the dispenser.
Figure 3:
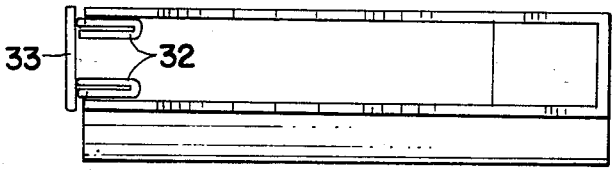
FIG. 3 is a bottom view of the cartridge dispenser shown in FIG. 1

A cartridge dispenser 10 as shown in FIGS. 1 and 2 includes a rear wall 12, a front wall 14, a left side wall 16, a right side wall 18 and a top wall 20. In a preferred embodiment, walls 12, 14, 16, 18 and 20 are constructed of transparent material but this is not critical in the construction of the present invention.

The rear wall 12 includes a top planar portion 22 and a bottom planar portion 24 which are joined by a curved portion 26 which angles towards the front wall 14 from the rear wall 12.

The dispenser 10 is designed to hold at least two columns of cartridges 28 each cartridge being held in a horizontal position as shown in FIGS. 1 and 2. The cartridges 28 are arranged one on top of the other with each column offset from one another as shown in FIG. 2.

The distance between the top planar portion 22 and the front wall 14 is selected to be more than the maximum diameter of the cartridge but less than twice this maximum diameter. The distance between the bottom planar portion 24 and the front wall 14 is selected to be slightly more than the maximum diameter of the cartridge so that the width here will accommodate a single cartridge but will not be so great that the cartridge jostles about when the dispenser 10 is being used.

The dispenser 10 has a cartridge dispenser chute 30 located at the bottom of the dispenser 10 as shown in FIG. 2. A spring or other resilient means 32 is mounted to the rear wall 12 and front wall 14 at one end of the cartridge dispenser chute as shown in FIGS. 1 and 2 for resiliently engaging the lowermost cartridge 28 within the housing. At the other end of the cartridge dispenser chute 30 is mounted a stop means 34 which in conjunction with spring 32 holds the cartridges 28 within the housing until they are physically removed by the user.

The rear wall 12 and front wall 14 have corresponding portions of thses walls removed to form a cut away 36 to enable a user to grasp the lowermost cartridge 28 to remove the cartridge from the dispenser 10.

A spring 38 is disposed within the interior of the dispenser 10 as shwon in FIGS. 1 and 2. This spring 38 is compressed when cartridges are loaded into the dispenser 10 and resiliently engages the interior of top wall 20 and the uppermost cartridge 28. This spring 38 prevents the cartridges 28 from being jostled about when the dispenser 10 is being used.

Each cartridge 28, particularly those used with rifles, has a primer end 40 and a bullet end 42. The diameter of the primer end 40 is generally larger than the bullet end 42. The primer end 40 includes a casing which has a transition region running from the larger diameter primer end 40 to the bullet 42. If no compensating means were provided, the cartridges 28 within dispenser 10 would not lie parallel to one another as a result of this difference in diameter. If this were so, there would be more chance of the cartridges 28 jamming within the dispenser 10 which could provide difficulties in removing these cartridges from the dispenser.

Figure 4:
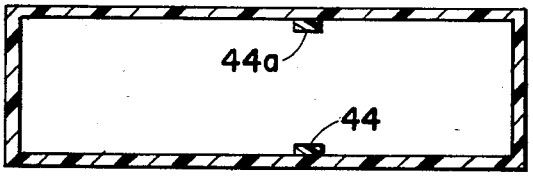
FIG. 4 is a cross-sectional view along line 4—4 in FIG. 1 and shows a cartridge dispenser according to a first embodiment of the present invention.

The inventor has discovered at least two embodiments which overcome this difficulty. The first embodiment is shown in FIGS. 2 and 4. Here guide strips 44 and **44*a* are mounted to the inside of front wall 14 and rear wall 12 respectively. These strips 44 and 44*a* are disposed adjacent the cartridge 28 where the cartridge has a reduced diameter, the transition region, and are sized to compensate for the reduced diameter. Thus, when cartridges 28 are loaded into dispenser 10, the cartridges are held in a horizontal position as shown in FIGS. 1 and 2** and parallel to one another.

Figure 5:
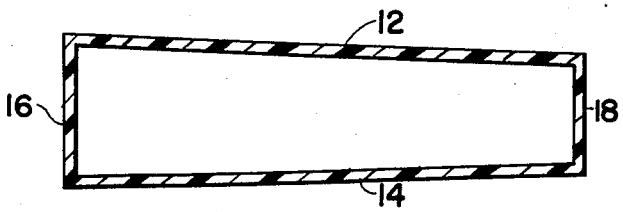
FIG. 5 is a cross-sectional view along line 5—5 in FIG. 1 and shows a cartridge dispenser according to a second embodiment of the present invention.

Another embodiment is shown in FIG. 5 which shows that the compensation for the reduced diameter of cartridges 28 is accomplished by selectively sizing the left side wall 16 and right side wall 18 so that the bullet end 42 of cartridge 28 is located in the portion of dispenser 10 which has a reduced dimension.

The rear wall 12 may be provided with a belt loop (not shown) or other structure so that a user can wear the dispenser on his belt.

In order to use this dispenser, a user grasps a cartridge to be inserted into the dispenser with his thumb and forefinger and loads the cartridge into the dispenser through chute 30. The cut away 36 enables the user to load the cartridge easily without interference from the front wall 14 and rear wall 12 of the dispenser 10. The user may load the dispenser in this manner until the dispenser is filled. When it is desired to remove a cartridge, the user grasps the lowermost cartridge through cut away 36 and pulls the cartridge downward through the spring 32. Other cartridges may be removed in the same manner.

While the fundamental novel features of the invention have been shown and described, it should be understood that various substitutions, modifications and variations may be made by those skilled in the art without departing from the spirit or scope of the invention. Accordingly, all such modifications and variations are included in the scope of the invention as defined by the following claims.

I claim:

1. A cartridge dispenser for dispensing cartridges having a casing and a bullet end, the casing further having a transition region running from the casing to the bullet comprising:

an open bottom housing having a top wall, a pair of opposed end walls, a front wall and a rear wall for holding at least two columns of cartridges, each cartridge having a casing end and a bullet end, in a normal horizontal position, one on top of the other with the cartridges being aligned with the casing end of each cartridge abutting the same end wall and with the cartridges in each column being offset from cartridges in the adjacent column;

the rear wall having a top planar portion and a bottom planar portion, the two planar portions being joined by a portion which angles toward the front wall from the top planar portion to the bottom planar portion;

the distance between the top planar portion and the front wall being more than the maximum diameter of a cartridge but less than twice the maximum diameter of a cartridge and the distance between the bottom planar portion and the front wall being slightly more than the maximum diameter of the cartridge;

the open bottom shaped to permit dispensing of cartridges from the housing in a vertical direction which is perpendicular to a plane formed by the bottom of the housing;

the open bottom of the housing having at one end thereof a stop means for holding the bullet end of the cartridge within the interior of the housing;

the open bottom of the housing having at the other end thereof a first resilient means engaging the lower most surface of the casing of the cartridge for yieldingly holding the cartridge within the interior of the housing; and guide (cam) means incorporated in opposing relation in the first and rear walls adjacent the transition region of the cartridge casing which guide means run from the top wall to a position approximately horizontally aligned with the top of the bottom planar portion, the dimension of the guide means in the direction between the rear wall and the front wall being selected to engage opposite sides of each cartridge to compensate for the smaller diameter of the cartridge in the transition region, which guide means in cooperation with the stop means and first resilient means cause each cartridge to be held in parallel relation to each other cartridge within the housing.

2. The cartridge dispenser according to claim 1 further having a:

second resilient means which is disposed within the housing and which extends between the top wall and the top most cartridge within the housing and which is compressed when cartridges are inserted in the housing whereby the cartridges are resiliently forced towards the stop means and first resilient means so that they do not move about within the housing when the housing is moved.

3. The cartridge dispenser according to claim 1 further having corresponding cut away portions in the front and rear walls, the cut away portions being in communication with the lower edge of these walls whereby a user can grasp a cartridge to be removed from the dispenser.

* * * * *